US006401342B1

(12) United States Patent
Kloss et al.

(10) Patent No.: US 6,401,342 B1
(45) Date of Patent: Jun. 11, 2002

(54) CUTTING KNIFE FOR CUTTING CEMENT BEADS OF WINDOW PANES

(75) Inventors: Günter Kloss, Oppenweiler; Walter Thomaschewski, Filderstadt; Georg Harsch, Tamm-Hohenstange, all of (DE)

(73) Assignee: C. & E. Fein GmbH & Co. (DE)

( * ) Notice: Subject to any disclaimer, the term of this patent is extended or adjusted under 35 U.S.C. 154(b) by 0 days.

(21) Appl. No.: 09/606,333

(22) Filed: Jun. 29, 2000

(30) Foreign Application Priority Data

Jul. 10, 1999 (DE) ..... 199 32 248

(51) Int. Cl.[7] ..... B26B 7/00; B26D 7/08
(52) U.S. Cl. ..... 30/272.1; 30/277.4
(58) Field of Search ..... 30/277.4, 272.1, 30/294, 287; 7/100; 29/235, 239, 270

(56) References Cited

U.S. PATENT DOCUMENTS

| | | | |
|---|---|---|---|
| 4,543,720 A | 10/1985 | Grunikiewicz et al. | 30/277.4 |
| 4,980,976 A | 1/1991 | Junginger et al. | 30/277.4 |
| 5,231,910 A | 8/1993 | Harsch et al. | 30/277.4 |

FOREIGN PATENT DOCUMENTS

| | | |
|---|---|---|
| DE | 86 17 670 | 2/1987 |
| EP | 0 141 035 A1 | 5/1985 |
| EP | 0 369 390 A1 | 5/1990 |
| EP | 0 433 539 A1 | 6/1991 |

OTHER PUBLICATIONS

International Search Report dated Oct. 11, 2000.

*Primary Examiner*—Douglas D. Watts
(74) *Attorney, Agent, or Firm*—St. Onge Steward Johnston & Reens LLC

(57) ABSTRACT

A cutting knife is provided for a cutting tool for severing cement beads of window panes that are cemented in motor vehicles. The cutting knife is formed from a flat material which is bent into the shape of an U. The knife comprises a cutting portion forming one leg of the U, a securement portion forming the other leg of the U, and an intermediate bridge that connects the cutting portion with the securement portion. The securement portion is provided at its free end with an opening for securing the knife to an oscillatory drive unit of the cutting tool and tapers from this securement opening toward the intermediate bridge. In one embodiment, the securement portion is provided with a curved section at the end adjacent the intermediate bridge. In another embodiment, the cutting portion has a cross-section with a central section that is defined by two parallel surfaces. A serrated or saw-like cutting edge is preferably provided on the cutting portion.

23 Claims, 8 Drawing Sheets

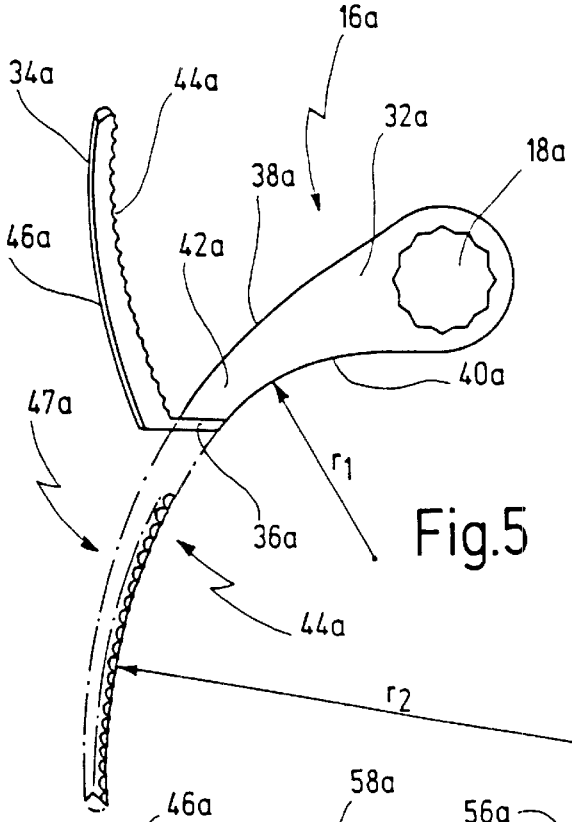
Fig.5
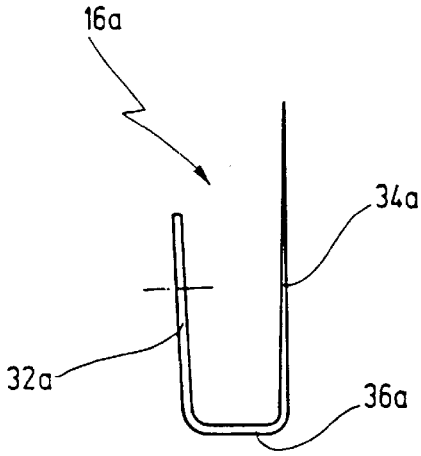
Fig.6
Fig.7
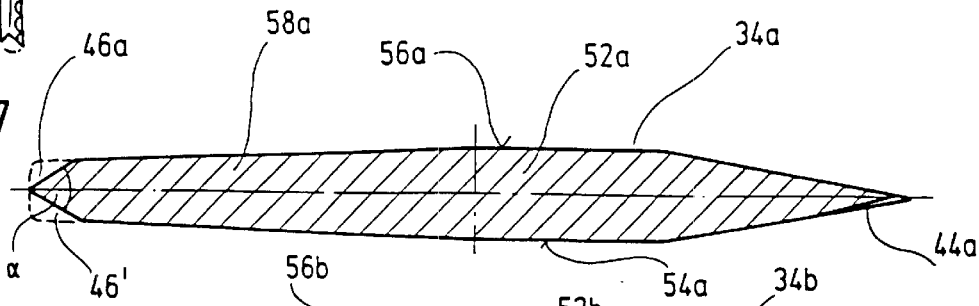
Fig.8
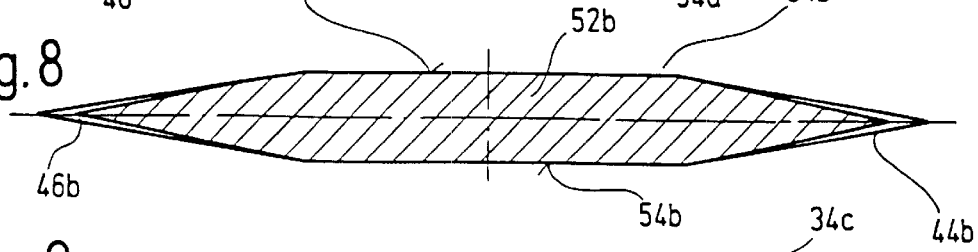
Fig.9
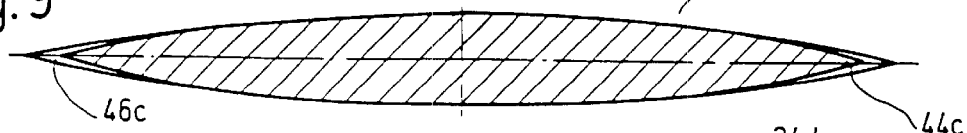
Fig.10
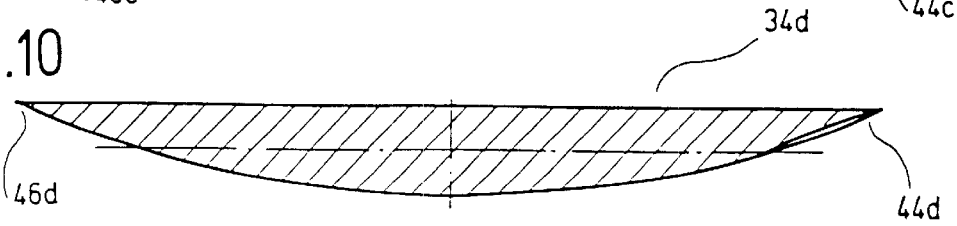

CUTTING KNIFE FOR CUTTING CEMENT BEADS OF WINDOW PANES

BACKGROUND OF THE INVENTION

The invention relates to a cutting knife for a cutting tool for severing a cement bead of a window pane cemented in a motor vehicle. The cutting knife is formed from a flat material which is bent into the shape of an U. The knife comprises a cutting portion forming one leg of the U, a securement portion forming another leg of the U, and an intermediate bridge that connects the cutting portion with the securement portion. The securement portion comprises an opening at its free end for securing the knife to an oscillatory drive unit of the cutting tool and tapers from this securement opening toward the intermediate bridge.

DESCRIPTION OF RELATED PRIOR ART

U-shaped cutting knives are known for example from DE-U1 86 17 670 or EP-B1 0 141 035. Such knives are known especially for removing windshields from motor vehicles when necessary due to window damage or leakage. If the problem is only leakage, one must take care that the window pane is not damaged by the high frequency oscillation of the cutting knife. In addition, when cutting through the cement bead that cements the window pane to the vehicle body flange, care must be taken not to damage the painting of this body flange. Otherwise, such damage could later lead to corrosion. Finally, the particular geometry of the window must be observed when removing the window, which depends upon the type of automobile and how the window is assembled.

With the conventional cutting knives of the art it has been found that considerable skill is still necessary to cut through the cement bead. Considerable force must be applied. In addition, the danger of the worker breaking the window with the oscillatory knife is still high.

SUMMARY OF THE INVENTION

It is an object of the present invention to provide an improved cutting knife which allows an easy removal of windows from motor vehicles.

It is a further object of the invention to provide an improved cutting knife which avoids clamping of the knife within the cement bead and requires less force than prior art knifes.

These and other objects of the invention are solved by providing a cutting knife of the above-mentioned type, wherein the securement portion comprises a curved section at the end thereof, said end being adjacent the intermediate bridge. The position of the cutting portion with respect to the cement bead when removing the windshield is optimised by the curved section. As a result, the cement bead can be cut with considerably less force. Further, a clamping of the knife in the cement bead is avoided.

In a preferred embodiment of the present invention, the curved section comprises a convex side edge facing the cutting portion, and a concave side edge opposing the cutting portion. Preferably, the curvature curvature of the the convex side edge is smaller than the curvature of the concave side edge.

With this feature, the geometry of the cutting portion with respect to the securement portion is further improved and the guidance of the cutting knife, preferably having a crescent-shaped curvature, when drawn through the cement bead, is improved. Furthermore, the stroke of the oscillation is better utilised when actually cutting through the cement bead.

In a further embodiment of the present invention, at least a side of the cutting portion that faces the securement opening comprises a serrated or saw-like cutting edge. This makes cutting through the cement bead easier, especially if it is a tough material, for example polyurethane.

In a further embodiment of the invention, a side of the cutting portion that opposes the securement opening comprises a cutting edge with a peak angle of at least 30°. Providing a cutting edge also on the side opposed to the securement opening simplifies the return of the cutting portion through a section which has already been cut, should this be required. Since the cutting edge on the side opposed to the securement opening has a large peak angle, i.e. is relatively "dull", the cross-section of the cutting portion is only slightly reduced, which on the whole adds to stability and reduces the danger of breakage.

In an alternative embodiment, a side of said cutting portion that opposes said securement opening comprises a blunt edge. This has the advantage that the cross-section of the cutting portion is further enlarged and thus the possibility of breakage further reduced.

In another aspect of the present invention the cutting portion comprises a cross-section with a central section defined by two parallel surfaces, which join into a sharp angle cutting edge at least on an end of the cutting portion facing the securement opening. This guarantees an optimal cutting process. In particular, the enlarged cross-section of the cutting portion leads to a greatly reduced danger of breakage. In addition, a possible clamping of the cutting knife in the cement bead is counteracted.

According to another aspect of the present invention, the cutting portion comprises a central section having parallel surfaces, said central section having one end adjoining said cutting edge, and further having another end adjoining a crowned or conical section. A distinctly improved cutting operation is achieved and the danger of breakage is also reduced. In addition, the cutting portion can be provided with a serrated or saw-like cutting edge in these embodiments, at least on the side facing the securement opening.

It will be understood that these embodiments of the invention can also be combined with a curved portion as described above on the securement portion and that the serrated edge can be provided on both sides of the cutting portion.

Further, it will be understood that the above-mentioned features and those to be discussed below may be used not only in the above combinations, but taken alone or in other combinations without departing from the scope of the present invention.

BRIEF DESCRIPTION OF THE DRAWINGS

Further features and advantages of the invention will become apparent from the following description of preferred embodiments taken in conjunction with the drawings.

FIG. 5 shows a side view of a slightly modified knife compared with the embodiment of FIG. 2.

FIG. 6 shows a front view of the knife of FIG. 5.

FIG. 7 shows a cross-section of the cutting portion according to FIG. 5 in greatly enlarged representation.

FIG. 8 shows a modified cross-section of the cutting portion according to FIG. 7.

FIG. 9 shows a further modified cross-section of the cutting portion of FIG. 7, which is known from the prior art.

FIG. 10 shows a further modification of the cross-section which is also known from the prior art.

DETAILED DESCRIPTION OF PREFERRED EMBODIMENTS

Figure 1:
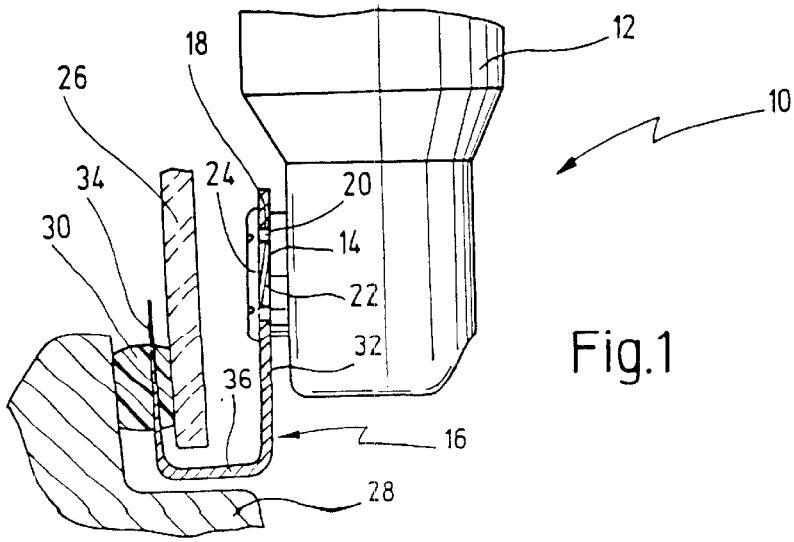
FIG. 1 shows the cross-section of a cutting knife according to the invention when used with an oscillatory drive unit.

The cutting tool according to the invention is designated in general in FIG. 1 with the numeral 10. The cutting tool 10 comprises an oscillatory drive unit 12. The shaft 14 is driven to oscillate at high frequency in the range of about 5,000 to 28,000 vibrations per minute at a small rotary angle in the range of about 0.5° and 5°. A cutting knife generally designated with the numeral 16 is fixed to the drive shaft 14. A securement opening 18 of the knife is form-fit to the multiple edges 20 of the drive shaft 14 and is secured with a screw 22 having a flat head 24 by means of a threading (not shown) of the drive shaft 14 of the cutting tool 10.

Figure 2:
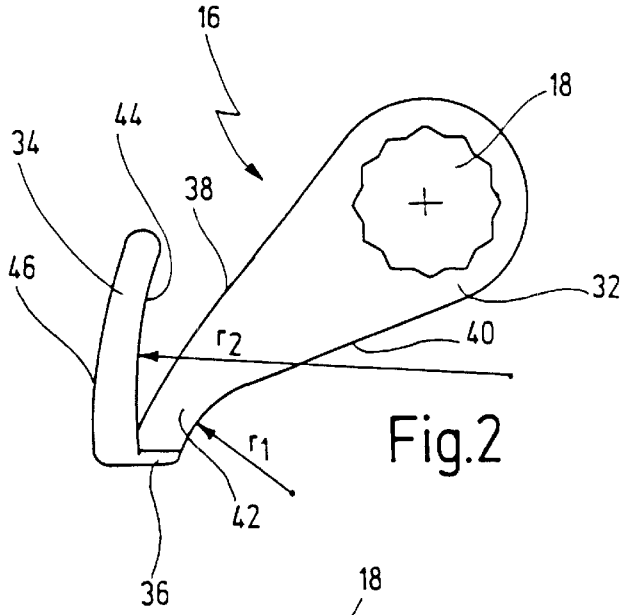
FIG. 2 shows a side view of a first embodiment of a knife according to the invention, which is enlarged compared to FIG. 1.

The knife is approximately U-shaped and angled in cross-section and comprises a first leg formed as a securement portion 32. A securement opening 18 is provided in the securement portion 32 in the form of a 12-edged opening as can be seen in FIG. 2. The securement portion 32 is connected to a second leg formed as a cutting portion 34 by means of an intermediate bridge 36.

The cutting tool 10 is adapted to cut through an cement bead for cementing a window 26 to a flange 28 on the body of a motor vehicle. For example, this window 26 can be the front windshield, which is completely cemented to the A-column of the car body by means of a peripheral adhesive cement bead 30. Normally, the bead 30 is made of a special polyurethane having high UV resistance and high mechanical strength as well as long-time durability. With the windshield being cemented to the A-column, the stability of the car body is increased.

Thus it is understandable that a very tough and stable material is employed, which when being cut to remove the window, for example after having been cracked by a stone, requires considerable application of force. This is the case even considering the enhancement action of the oscillatory drive 12. For this reason, numerous variations of the cutting knife have been developed in the prior art.

However, even small alterations of the geometry of the knife can lead to major effects in the cutting procedure due to the material strength of the cement bead and the particular geometric configuration. The cutting knife 16 according to the present invention as shown in FIG. 2 distinguishes over the prior art in that the flat securement portion 32 does not have straight side edges as in the prior art, but is provided with a curved or knee section 42 which leads into the bridge 36. The two side edges 38 and 40 run from the securement opening 18 toward the bridge 36, such that the securement portion 32 is tapered in the direction of the bridge 36.

The curved section 42 is formed such that the side edge 38 of the securement portion 32 facing the cutting portion 34, in the region directly adjacent the cutting portion 34, has a slight concave curvature. On the other hand, the side edge 40 opposing to the cutting portion 34 is provided with a strong curvature with a radius $r_1$ just before the bridge 36, the radius of curvature being smaller than that on the other side edge 38.

The cutting portion 34 has a crescent-like curvature, where the crescent in this embodiment is concave with respect to the securement opening 18. The cutting portion 34 includes a cutting edge 44 facing the securement opening 18 and a further cutting edge 46 on the side opposing the securement opening 18, both of which must be resharpened from time to time during operation.

The cutting edge 44 facing the securement opening 18 is provided with a radius of curvature $r_2$ which is distinctly larger than the radius of curvature $r_1$ of the side edge 40 at the curved section 42 on the securement portion 32. These geometrical conditions are better seen in FIG. 4 which illustrates a simple pre-form designated with the numeral 47. The pre-form 47 is a flat piece (normally a stamped piece), from which the U-shaped angled knife 16 can be fabricated by bending along the lines 48 and 50. The grinding or sharpening of the cutting portion 34 at its two edges 44 and 46 is normally done after the bending procedure.

A particularly favourable geometry results in that the radius of curvature $r_1$ of the side edge 40 in the region of the curved section 42 is much smaller than the radius of curvature $r_2$ of the cutting edge 44 of the cutting portion 34. As a result, the securement portion 32 is particularly thin in the region opposite the cutting portion 34, which in operation is located at the edge region of the window 26 as shown in FIG. 1. This simplifies the cutting work, particularly around corners of the window 26 and enhances the full use of the oscillation stroke when cutting the cement bead 30.

Figure 4:
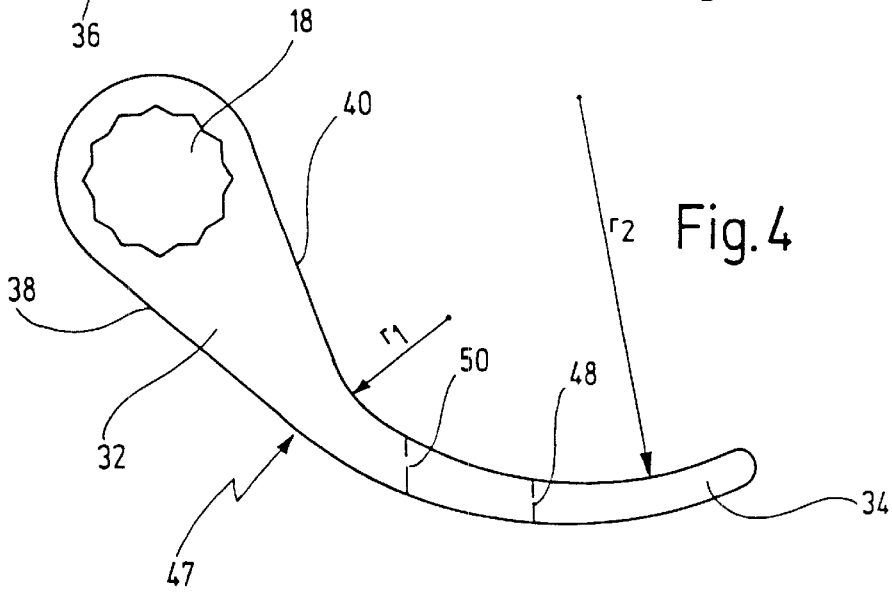
FIG. 4 shows a so-called pre-form of the knife of FIG. 2, i.e. a flat piece for forming the cutting knife by bending.

In addition, the relative position of the cutting portion 34 with respect to the securement opening 18 is influenced by the angle of the bending lines 48 and 50 shown in FIG. 4. These can also be optimised with respect to the geometry.

Another embodiment of the knife according to the invention is shown in FIGS. 5 and 6 and designated in general with the numeral 16*a*. The knife 16*a* is again U-shaped and angled in cross-section, as seen in FIG. 6, and includes a securement portion 32*a* with a securement opening 18*a*, a bridge 36*a* and a cutting portion 34*a*.

The cutting portion 34*a* also has a crescent-like curvature, where the curvature is concave with respect to the securement opening 18*a*. The cutting portion 34*a* has a cutting edge 44*a* on the side facing the securement opening 18*a*, which is provided with a serrated cutting edge. On the side opposing the securement opening 18*a*, the cutting portion 34*a* has a further cutting edge 46*a*, which however has a relatively large peak angle $\alpha$ of at least 30°, preferably about 40° to 50°. The peak angle $\alpha$ is better seen in the enlarged cross-section of the cutting portion 34*a* shown in FIG. 7.

The serrated structure on the cutting edge 44 can be automatically fabricated, preferably by means of an NC controlled grinding machine. The cutting edge 44*a* could also be provided with a saw-like edge. With the serrated or saw-like edge, the knife 16*a* has a distinctly improved cutting capacity especially for very tough materials. Despite the serrated edge, a repeated manual resharpening is possible by using the oscillating action of the drive unit together with a grinding stone.

Figure 3:
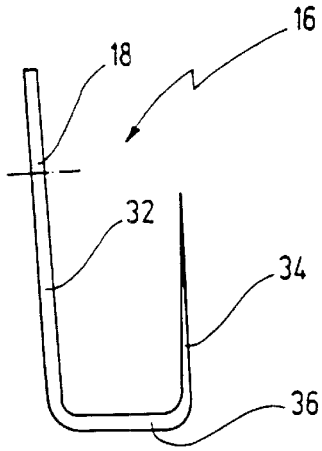
FIG. 3 shows a front view of the knife of FIG. 2.

The securement portion 32*a* also comprises a curved section 42*a*. In contrast to the arrangement shown in FIGS. 2 to 4, both side edges 38*a* and 40*a* have continuous curvatures, which run along either side of the securement opening 18*a* and approach one another. The side edge 38*a* of the securement portion 32*a* facing the cutting portion 34*a* has a concave curvature. The side edge 40*a* on the side opposing the cutting portion 34*a* has a convex curvature.

The part of the cutting portion 34*a* belonging to the pre-form 47*a* is shown in the lower half of FIG. 5 by the dot-dashed lines. The cutting portion 34*a* at the cutting edge 44*a* facing the securement opening 18*a* again has a much larger radius $r_2$ compared with the radius of curvature $r_1$ in the region of the curved section 42*a* of the securement portion 32*a*.

In the following, various different cross-sections are discussed in conjunction with FIGS. 7 to 10, where the illustrations are greatly enlarged. The cross-sections in FIGS. 9 and 10 represent arrangements according to the prior art. In FIG. 9, the cutting portion 34*c* is crowned or bulged on both sides and the two cutting edges 44*c* and 46*c* are provided with a serrated cutting edge. In FIG. 10, one side of the cutting portion 34*d* has a flat surface, while the other side is crowned. Only the end facing the securement portion is provided with a serrated grinding at the cutting edge 44*d*, while the other cutting edge 46*d* has a straight cut.

FIGS. 7 and 8 show particularly preferred cross-sections of the cutting portion according to the invention, through which distinctly improved mechanical stability and reduced breakage is achieved. In addition, the working process is greatly improved, particularly through the reduced possibility of clamping in the cement bead.

In the embodiment of FIG. 8, the cutting portion 34*b* has a central section 52*b* defined by two parallel surfaces 54*b* and 56*b*. This central section 52*b* runs sharply out to the two cutting edges 44*b* and 46*b*, where the two cutting edges 44*b* and 46*b* are provided with a serrated edge. The wave-like grinding is applied from the two side surfaces, so that the serrated structure (serrations) is symmetrical.

In the embodiment of FIG. 7, the first section 52*a* with the parallel surfaces 54*a* and 56*a* joins to a section 58*a* having two surfaces which run slightly conically together, so that the cutting portion 34*a* at its section opposed to the securement opening 18*a* is provided with an undercut on both sides. At the end opposed to the securement opening 18*a*, the section 58*a* has a cutting edge 46*a*, which as explained above has a relatively large peak angle $\alpha$.

As the cutting portion 34*a* cuts mainly with the cutting edge 44*a* facing the securement opening 18*a* and as the other cutting edge 46*a* is largely intended for return of the cutting knife through a part of the cement bead already cut, an increased mechanical stability and therefore a reduced breakage capacity of the cutting knife is guaranteed also in this region. Furthermore, the cutting edge 44*a* is provided with a serration only on one side as opposed to the embodiment of FIG. 8.

An alternative embodiment of the cutting portion 34*a* is also shown in FIG. 7. The cutting portion 34*a* at the end opposed to the securement opening 18*a* is provided with a blunt edge as shown by the dashed line 46'. When it is not necessary to enhance the return of the cutting portion through an already cut cement bead with at least a partially formed cutting edge, this alternative offers advantages due to a further increase in mechanical stability.

Figure 11:
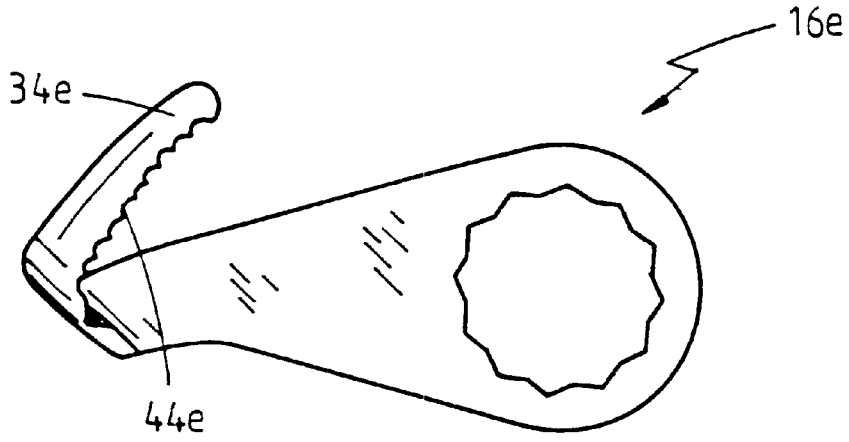
FIG. 11 shows a side view of another embodiment of a knife according to the invention.
Figure 12:
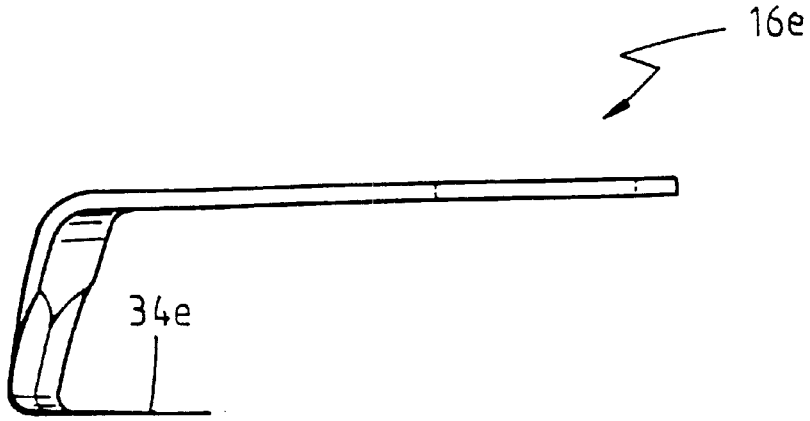
FIG. 12 shows a front view of the knife of FIG. 11.
Figure 13:
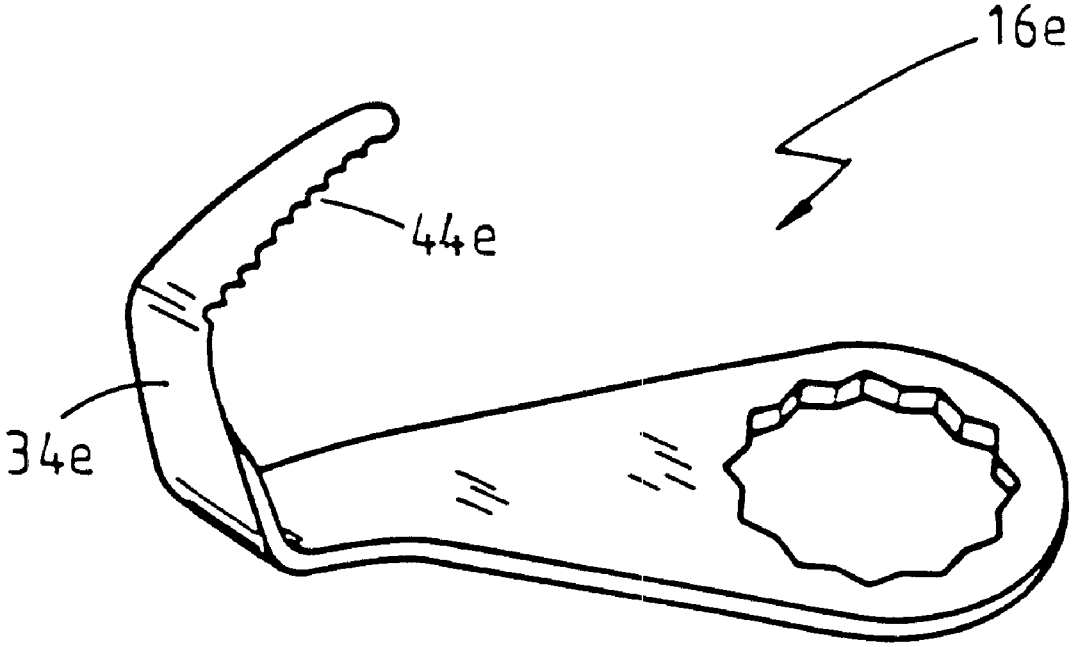
FIG. 13 shows a perspective elevated view of the knife of FIG. 11.

Another embodiment of a knife according to the invention is shown in a side view, a front view and a perspective view in FIGS. 11, 12 and 13, respectively. The overall shape of the knife 16*e* is almost identical to that shown in FIG. 2 except that the cutting portion 34*e* has a serrated cutting edge 44*e* and is considerably shorter than the cutting portion 34 of knife 16.

Figure 14:
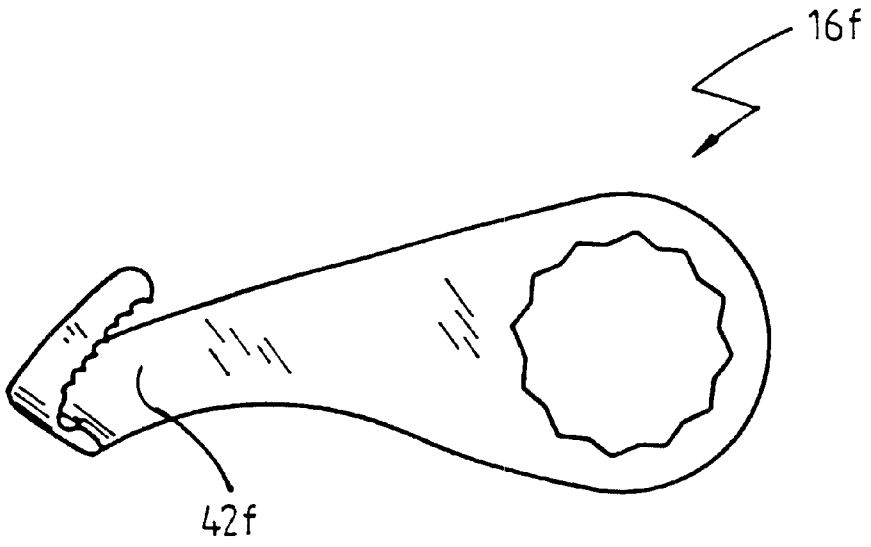
FIG. 14 shows a side view of a further embodiment of a knife according to the invention.
Figure 15:
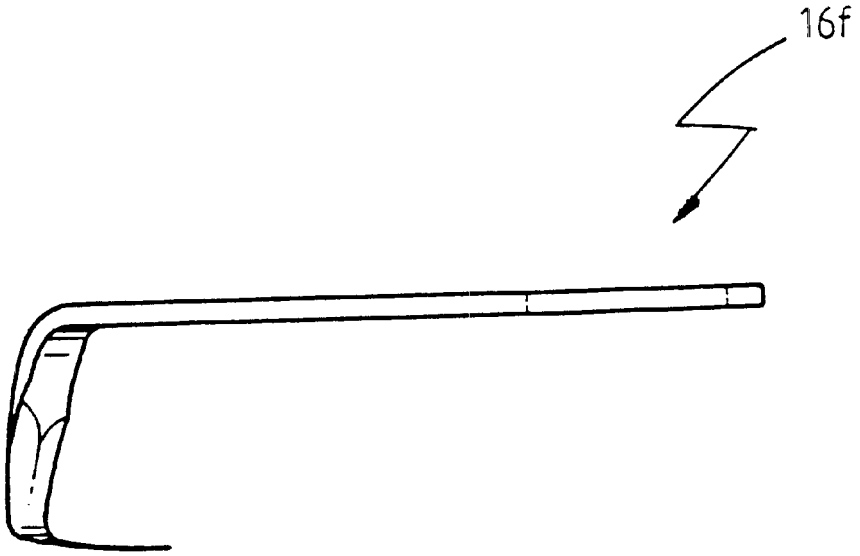
FIG. 15 shows a front view of the knife of FIG. 14.
Figure 16:
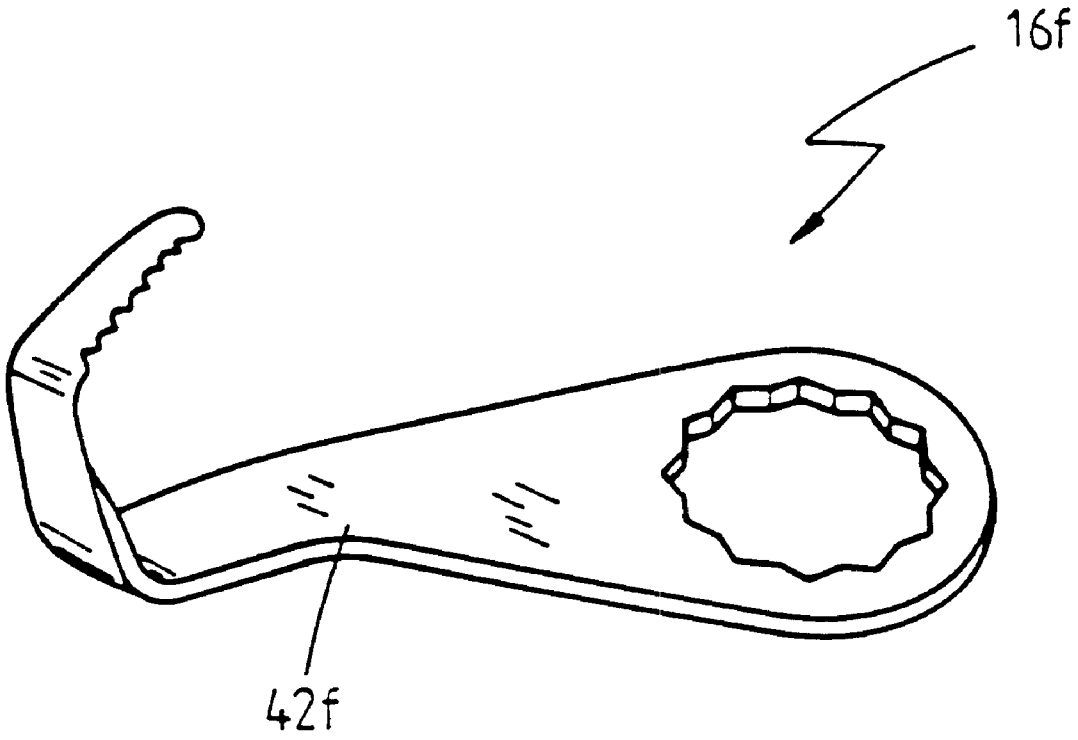
FIG. 16 shows a perspective elevated view of the knife of FIG. 14.

A further embodiment of a knife according to the invention is illustrated in a side view, a front view and a perspective view in FIGS. 14, 15 and 16, respectively. Knife 16*f* comprises a curved section 42*f* that is shorter than the corresponding curved section 42 of knife 16.

Figure 17:
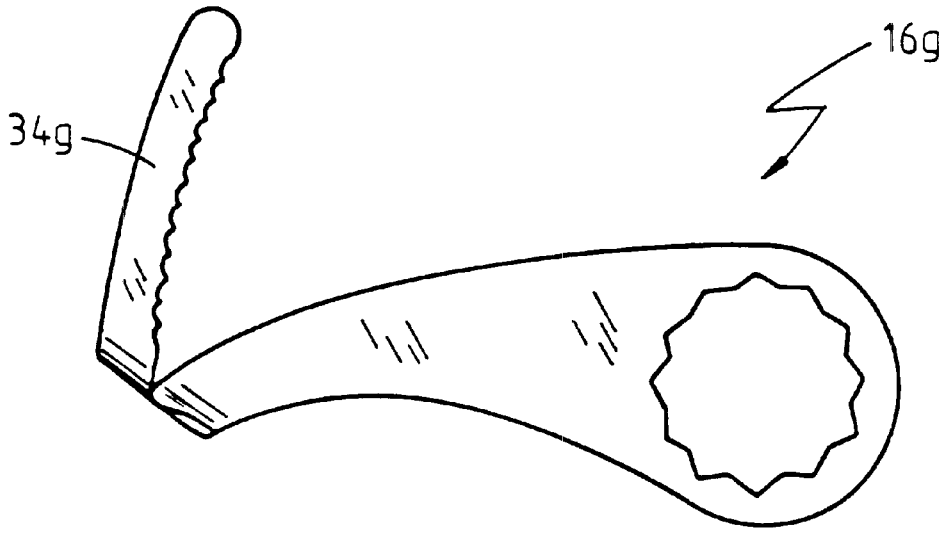
FIG. 17 shows a side view of yet another embodiment of a knife according to the invention.
Figure 18:
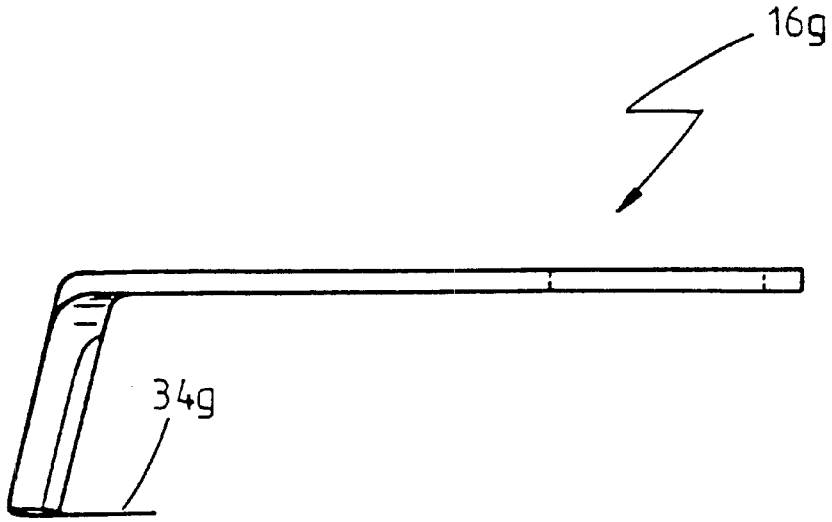
FIG. 18 shows a front view of the knife of FIG. 17.
Figure 19:
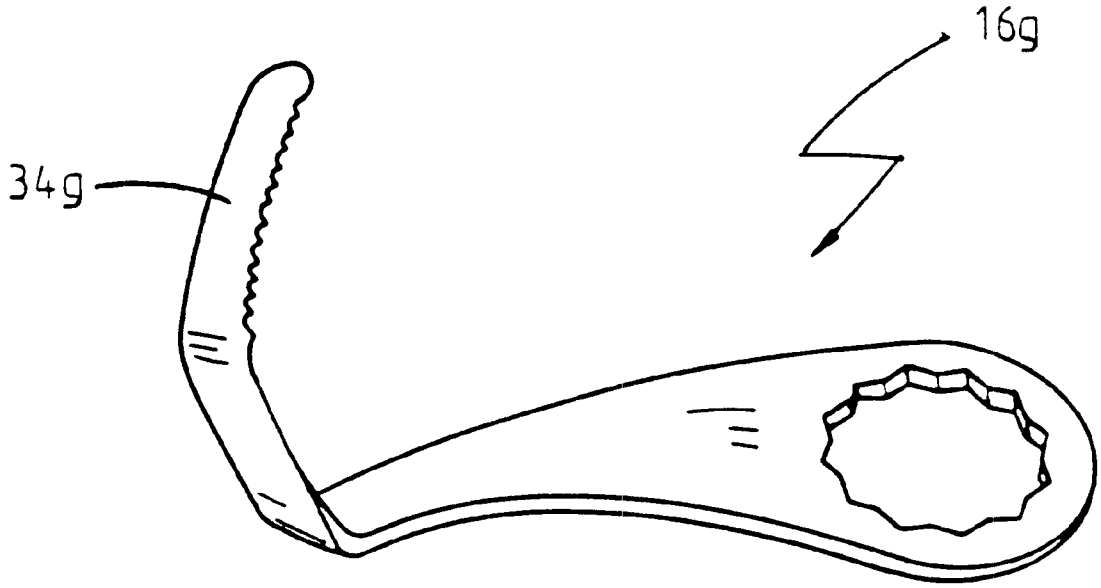
FIG. 19 shows a perspective elevated view of the knife of FIG. 18.

FIGS. 17, 18 and 19 show yet another embodiment of a knife according to the invention in a side view, a front view and a perspective view, respectively. The overall shape of the knife 16*g* is almost identical to that shown in FIG. 5 except that the cutting portion 34*g* is larger and has a smaller curvature than the corresponding cutting portion of 34*a* of knife 16*a*.

What is claimed is:

1. A cutting knife for a cutting tool equipped with an oscillatory drive unit, for severing a cement bead of a window pane cemented in a motor vehicle, said cutting knife being formed from a flat material bent into the shape of an U, said cutting knife comprising:

a cutting portion forming one leg of said U, a securement portion forming another leg of said U, and an intermediate bridge connecting said cutting portion with said securement portion;

wherein said securement portion comprises an opening at a free end thereof for securing said cutting knife to said oscillatory drive unit, and a curved section at another end thereof, said another end opposing said free end and being adjacent said intermediate bridge;

wherein said securement portion tapers from said securement opening toward said intermediate bridge;

wherein said curved section comprises a concave side edge opposing said cutting portion and having a first radius of curvature;

wherein said cutting portion comprises a concave cutting edge arranged on a side facing said opening, said concave cutting edge having a second radius of curvature;

said second radius of curvature being larger than said first radius of curvature.

2. The cutting knife of claim 1, wherein said curved section comprises a convex side edge facing said cutting portion, and a concave side edge opposing said cutting portion.

3. The cutting knife of claim 1, wherein said curved section comprises a convex side edge facing said cutting portion and having a first curvature, and a concave side edge opposing said cutting portion and having a second curvature, the first curvature being smaller than the second curvature.

4. The cutting knife of claim 1, wherein at least a side of said cutting portion that faces said securement opening comprises a serrated cutting edge.

5. The cutting knife of claim 1, wherein at least a side of said cutting portion that faces said securement opening comprises a saw-like cutting edge.

6. The cutting knife of claim 1, wherein a side of said cutting portion that opposes said securement opening comprises a cutting edge having a peak angle of at least 30°.

7. The cutting knife of claim 1, wherein a side of said cutting portion that opposes said securement opening comprises a blunt edge.

8. A cutting knife for a cutting tool equipped with an oscillatory drive unit, for severing a cement bead of a window pane cemented in a motor vehicle, said cutting knife being formed from a flat material bent into the shape of an U, said cutting knife comprising:

a cutting portion forming one leg of said U, a securement portion forming another leg of said U, and an intermediate bridge connecting said cutting portion with said securement portion;

wherein said securement portion comprises an opening at a free end thereof for securing said cutting knife to said oscillatory drive unit;

wherein said securement portion tapers from said securement opening toward said intermediate bridge; and wherein the cutting portion has a cross-section with a central section defined by two parallel surfaces, which join into a sharp angle cutting edge at least on an end of the cutting portion facing the securement opening;

where in said curved section comprises a concave side edge opposing said cutting portion and having a first radius of curvature;

wherein said cutting portion comprises a concave cutting edge arranged on a side facing said opening, said concave cutting edge having a second radius of curvature;

said second radius of curvature being larger than said first radius of curvature.

9. The cutting knife of claim 8, wherein at least a side of said cutting portion that opposes said securement opening comprises a serrated cutting edge.

10. The cutting knife of claim 8, wherein at least a side of said cutting portion that opposes said securement opening comprises a saw-like cutting edge.

11. The cutting knife of claim 8, wherein a side of said cutting portion that opposes said securement opening comprises a cutting edge having a peak angle of at least 30°.

12. The cutting knife of claim 8, wherein a side of said cutting portion that opposes said securement opening comprises a blunt edge.

13. A cutting knife for a cutting tool equipped with an oscillatory drive unit, for severing a cement bead of a window pane cemented in a motor vehicle, said cutting knife being formed from a flat material bent into the shape of an U, said cutting knife comprising:

a cutting portion forming one leg of said U, a securement portion forming another leg of said U, and an intermediate bridge connecting said cutting portion with said securement portion;

wherein said securement portion comprises an opening at a free end thereof for securing said cutting knife to said oscillatory drive unit;

wherein said securement portion tapers from said securement opening toward said intermediate bridge;

wherein a side of said cutting portion that faces said securement opening comprises a cutting edge; and wherein said cutting portion comprises a central section having parallel surfaces, said central section having one end adjoining said cutting edge, and further having another end adjoining a crowned section.

14. The cutting knife of claim 13, wherein at least a side of said cutting portion that opposes said securement opening comprises a serrated cutting edge.

15. The cutting knife of claim 13, wherein at least a side of said cutting portion that opposes said securement opening comprises a saw-like cutting edge.

16. The cutting knife of claim 13, wherein a side of said cutting portion that opposes said securement opening comprises a cutting edge having a peak angle of at least 30°.

17. The cutting knife of claim 13, wherein a side of said cutting portion that opposes said securement opening comprises a blunt edge.

18. A cutting knife for a cutting tool equipped with an oscillatory drive unit, for severing a cement bead of a window pane cemented in a motor vehicle, said cutting knife being formed from a flat material bent into the shape of an U, said cutting knife comprising:

a cutting portion forming one leg of said U, a securement portion forming another leg of said U, and an intermediate bridge connecting said cutting portion with said securement portion;

wherein said securement portion comprises an opening at a free end thereof for securing said cutting knife to said oscillatory drive unit;

wherein said securement portion tapers from said securement opening toward said intermediate bridge;

wherein a side of said cutting portion that faces said securement opening comprises a cutting edge; and wherein said cutting portion comprises a central section having parallel surfaces, said central section having one end adjoining said cutting edge, and further having another end adjoining a conical section.

19. The cutting knife of claim 18, wherein at least a side of said cutting portion that opposes said securement opening comprises a serrated cutting edge.

20. The cutting knife of claim 18, wherein at least a side of said cutting portion that opposes said securement opening comprises a saw-like cutting edge.

21. The cutting knife of claim 18, wherein a side of said cutting portion that opposes said securement opening comprises a cutting edge having a peak angle of at least 30°.

22. The cutting knife of claim 18, wherein a side of said cutting portion that opposes said securement opening comprises a blunt edge.

23. A cutting knife for a cutting tool equipped with an oscillatory drive unit, comprising:

a cutting portion, a securement portion, and an intermediate bridge forming a shape of a U;

said securement portion connected to the oscillatory drive unit and forming a first generally vertical leg of the U;

said cutting portion spaced apart from said securement portion and forming a second generally vertical leg of the U;

said intermediate bridge in contact with an d connecting both said securement portion and said cutting portion, said intermediate bridge forming a generally horizontal leg of the U; and said securement portion further comprising a curved section adjacent to said intermediate bridge for facilitating maneuverability of said cutting portion.

* * * * *